United States Patent [19]

Scales

[11] Patent Number: 4,564,311

[45] **Date of Patent: * Jan. 14, 1986**

[54] PROTECTIVE JACKET FOR USE IN REVETMENT STRUCTURES

[75] Inventor: John M. Scales, Norcross, Ga.

[73] Assignee: Nicolon Corporation, Norcross, Ga.

[ * ] Notice: The portion of the term of this patent subsequent to Jan. 25, 2000 has been disclaimed.

[21] Appl. No.: 460,447

[22] Filed: Jan. 24, 1983

Related U.S. Application Data

[63] Continuation-in-part of Ser. No. 201,569, Oct. 28, 1980, Pat. No. 4,370,075.

[51] Int. Cl.[4] ..... E02B 3/12; F02D 17/20

[52] U.S. Cl. ..... 405/20; 52/596; 404/35; 404/41

[58] Field of Search ..... 405/15–20, 405/29; 404/40–45, 35, 37, 38; 52/223 R, 227, 248, 585, 596, 597, 606

[56] References Cited

U.S. PATENT DOCUMENTS

| | | | |
|---|---|---|---|
| 1,071,091 | 8/1913 | Rogers | 405/20 |
| 1,207,738 | 12/1916 | Fraley | 404/40 |
| 1,411,415 | 4/1922 | Cooley | 404/40 |
| 2,877,506 | 3/1959 | Almoslino | 52/227 |
| 3,699,686 | 10/1972 | De Winter . | |
| 3,869,530 | 3/1975 | Williams | 52/248 X |
| 4,152,875 | 5/1979 | Soland | 52/227 |
| 4,227,829 | 10/1980 | Landry . | |
| 4,370,075 | 1/1983 | Scales | 405/20 R |

FOREIGN PATENT DOCUMENTS

| | | | |
|---|---|---|---|
| 2752545 | 11/1977 | Fed. Rep. of Germany . | |
| 8600 | 5/1908 | France | 405/19 |

*Primary Examiner*—Cornelius J. Husar
*Assistant Examiner*—Nancy J. Stodola
*Attorney, Agent, or Firm*—Kilpatrick & Cody

[57] ABSTRACT

A jacket for protecting rope, cable, chain or other connecting means used to interconnect blocks, grids or other forms in a revetment structure. The protective jacket comprises tubing which extends in substantially continuous form through the revetment structure and surrounds the connecting means and protects it from abrasion, as well as from degradation and deterioration caused by contact with water, salt sand, ice, sunlight and ultraviolet light, and other components of the environment.

3 Claims, 5 Drawing Figures

PROTECTIVE JACKET FOR USE IN REVETMENT STRUCTURES

This application is a continuation-in-part of my earlier application filed on Oct. 28, 1980, having Ser. No. 201,569, entitled Revetment Grids and Mats, and having a prospective issuance date of Jan. 25, 1983 with prospective U.S. Pat. No. 4,370,075, which application is incorporated herein by reference.

BACKGROUND OF THE INVENTION

This invention relates to certain revetment structures and to a jacket for protecting rope, cable, chain or other connecting means utilized in those revetment structures.

Revetment structures frequently comprise forms, which may be blocks or grids formed of precast concrete or other material, which forms are interconnected and flexibly bound to one another by rope, cable, chain or other connecting means which pass through holes, tunnels or openings in the blocks or grids. Such revetment structures are disclosed in my U.S. Pat. No. 4,370,075, issued on Jan. 25, 1983 mentioned above. These revetment structures are typically used for stablization of banks of streams and rivers, levies, river bottoms, shores, ditches, channels, canals and other earthen structures, and for protection of these structures against water or wind erosion.

Because these revetment structures are continuously exposed to forces caused by waves and ground movement, the blocks or grids forming them shift or change positions in relation to one another. Consequently, any connecting means penetrating these blocks or grids will wear against the block or grid surfaces and suffer abrasion. Furthermore, these revetment structures and their connecting means are continually exposed to sunlight. Portions of the sunlight spectrum, particularly ultraviolet light, cause degradation and deterioration of certain materials typically used in these connecting means, such as polyethylene, polypropylene, polyvinyl chloride and other synthetic or polymeric materials. Furthermore, scouring and abrasion action by salt water, sand, ice and other elements of the environment cause degradation and deterioration. As these synthetic or polymeric materials are increasingly used to fabricate connecting means for use in revetment structures because of their inertness, low weight and high tensile strength, their degradation and deterioration caused by abrasion, sunlight and the environment becomes increasingly a larger problem.

Prior attempts to minimize or prevent at least a portion of this degradation or deterioration include the placement of substantially tubular plastic inserts in the mold in which the blocks or grids forming revetment structures are cast. Such inserts are fixed within the blocks or grids, however, and their edges may abrade and cut the connecting means. Furthermore, such inserts do not protect the portions of the connecting means extending between the blocks or grids which are exposed to sunlight and the environment or achieve other features and benefits of the present invention.

SUMMARY OF THE INVENTION

The present invention comprises tubing which is inserted through openings in the blocks or grids of the revetment structure being formed and which extends, in substantially continuous form, from beyond one end or side of the revetment structure to beyond the other. Rope, cable, chain or other connecting means, linking or interconnecting the blocks or grids, passes through the tubing and is protected by it.

It is thus an object of the protective jacket of the present invention to protect the rope, cable, chain or other connecting means which passes through openings in blocks or grids in a revetment structure from abrading against the interior surfaces and the edges of these openings.

Another object of the protective jacket of the present invention is to allow effective use in revetment structures of relatively inexpensive rope, cable or other connecting means such as that formed of polyethylene, polypropylene, polyvinyl chloride or other synthetic or polymeric material, which is susceptible to abrasion.

It is a further object of the protective jacket of the present invention to protect exposed portions of rope, cable, chain or other connecting means used in revetment structures from degradation or deterioration caused by sunlight or ultraviolet light, and by contact with elements of the environment.

It is still another object of the protective jacket of the present invention to make easier the task of threading highly flexible rope, cable, chain or other connecting means through openings in blocks or grids comprising revetment structures.

It is also an object of the protective jacket of the present invention to reduce the flexibility of articulable revetment structures, and thereby to stablize such structures, by limiting the ability of blocks or grids comprising them to shift or change positions with respect to one another.

Other objects and advantages of the present invention will become apparent during the course of the following description.

DETAILED DESCRIPTION OF THE DRAWINGS

Figure 1:
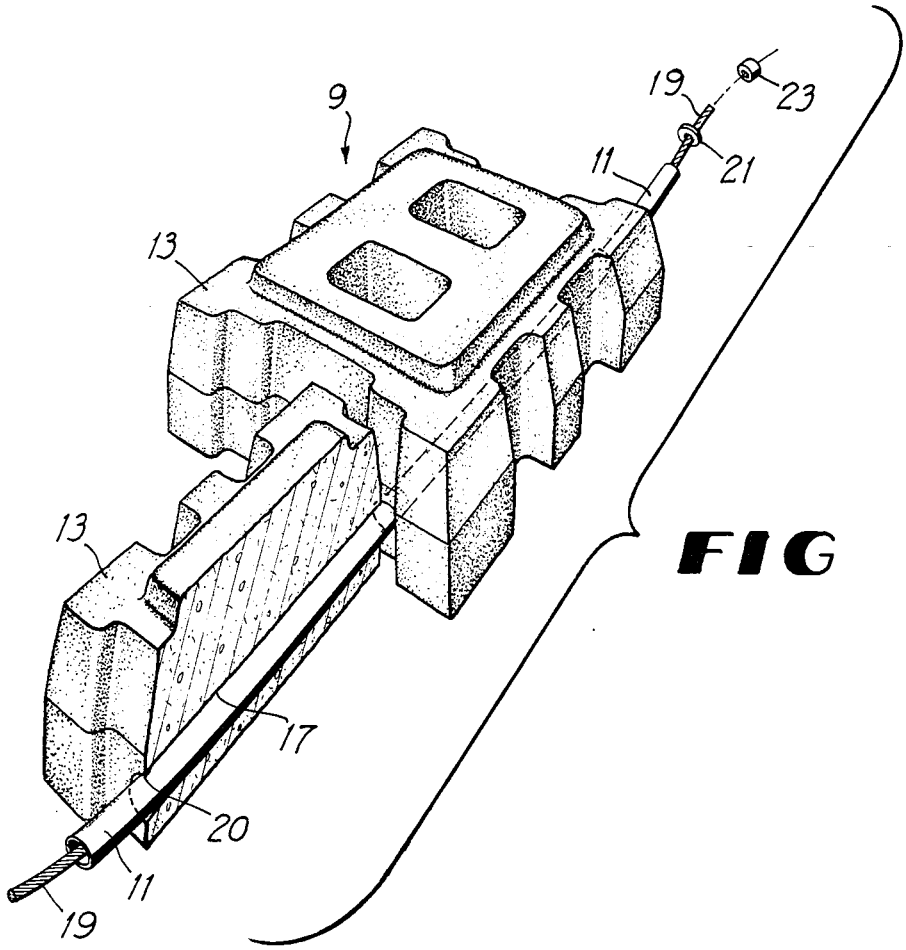
FIG. 1 is a perspective partial cutaway view of two grids of a revetment structure interconnected by rope and incorporating the protective jacket of the present invention.

FIG. 1 is a perspective view of two grids of a revetment structure 9 incorporating a protective jacket 11 of the present invention. Revetment structure 9 may be any structure comprising blocks, grids or other forms interconnected by rope, cable, chain or other connecting means.

Figure 2:
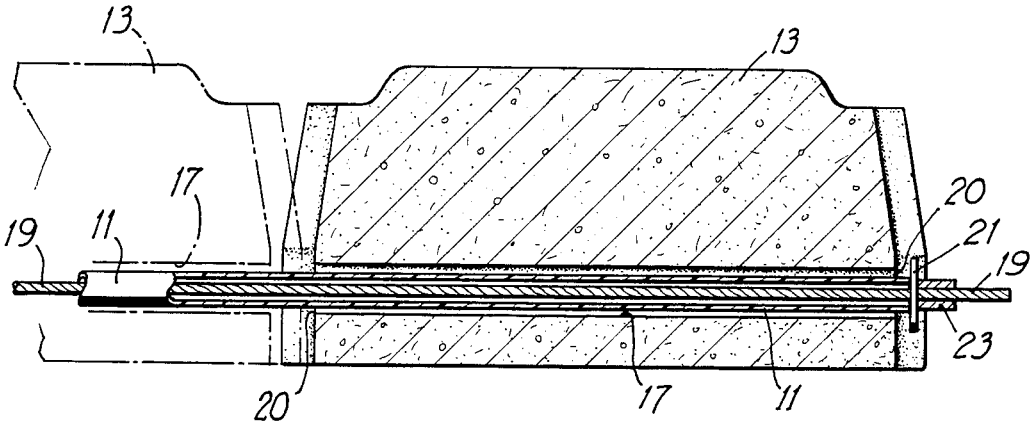
FIG. 2 is a cross-sectional view of a grid used in the revetment structure of FIG. 1, penetrated by rope which is protected by the protective jacket of the present invention.
Figure 3:
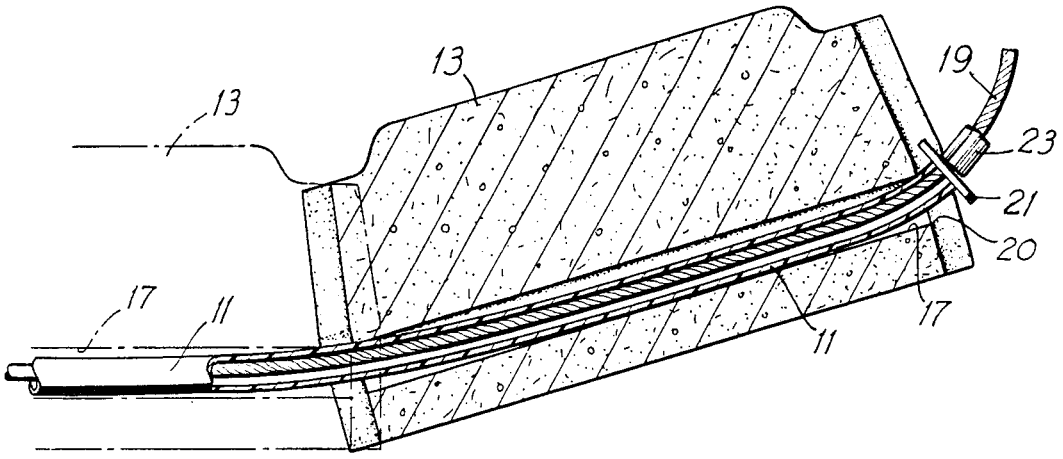
FIG. 3 is a cross-sectional view of a grid used in the revetment structure of FIG. 1, showing disposition of the protective jacket of the present invention and the connecting means when the grid is being lifted by the connecting means.
Figure 4:
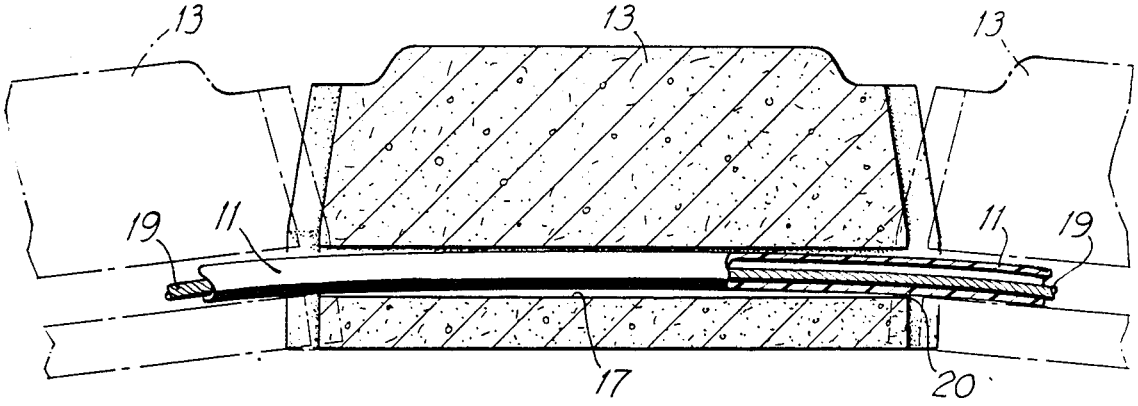
FIG. 4 is a cross-sectional view of a grid used in the revetment structure of FIG. 1, showing disposition of the protective jacket of the present invention and the connecting means when the revetment structure is disposed on a convex surface.

FIGS. 2 through 4 show the placement of jacket 11 of the present invention within a grid 13 of revetment structure 9. Grid 13 may be a block or other form cast or constructed of concrete or other suitable material, and it may be precast or preformed. Jacket 11 is disposed in opening 17 of grid 13, which may be a tunnel, hole, slot, groove or other cavity in grid 13 which accepts connecting means 19. Connecting means 19, which may be synthetic, polymeric or natural fiber rope, metallic or non-metallic cable, chain or other material, is disposed within jacket 11 and at either or both ends it may be fitted with washers 21 and swage fittings 23 to hold connecting means 19 in place in revetment structure 9.

Jacket 11 of the present invention comprises tubing constructed of polyethylene, polypropylene, polyvinyl chloride or other polymer-resin based material or other material reasonably resistant to abrasion from concrete or other rough surfaces and edges. Such material forming jacket 11 may include ultraviolet light stabilization material such as lampblack or other chemical stabilizers to reduce penetration by, and consequent degradation and deterioration from ultraviolet light and other portions of the sunlight spectrum. Furthermore, the material forming jacket 11 may be impermeable to water and/or air, in order to protect connecting means 19 from degradation, deterioration or corrosion from exposure to salt water and other components of the environment of revetment structures 9.

Jacket 11 is preferably placed or inserted in revetment structure 9 so that it extends, in continuous form, from beyond one end or side of revetment structure 9 to beyond the other, in order to insure maximum protection to connecting means 19. Preferably, as illustrated in FIGS. 2 and 3, jacket 11 extends through revetment structure 9 beyond the outer edges 20 of openings 17 of end grids 13 in the revetment structure 9, in order to allow connecting means 19 and jacket 11 to absorb changes in dimensions of revetment mat 9 caused by placement on irregular surfaces, changes in grid spacing and the like. Where jacket 11 is manufactured in segment form, or where for other reasons jacket 11 does not extend in continuous form for the length or width of revetment structure 9, abutting ends of jacket 11 within revetment structure 9 may be joined by heat bonding or other means, or they may remain unjoined.

FIGS. 3 and 4 illustrate the protection of connecting means 19 provided by jacket 11 of the present invention against abrasion from edges 20 of openings 17 in grids 13. Without the intervention of jacket 11 of the present invention, connecting means 19 would wear directly against edge 20 of opening 17 as revetment structure 9 is being hoisted by connecting means 19. Similarly, such wearing and cutting would occur when revetment structure 9 is disposed on a concave surface, or on a convex surface as illustrated in FIG. 4. As can be seen, jacket 11 provides a relatively smooth continuous surface along which connecting means 19 may travel, and protects connecting means 19 from wearing against the edges 20 of the openings 17 and grids 13. Furthermore, jacket 11 slides with connecting means 19 within revetment structure 9 and further prevents abrasion of connecting means 19 in this fashion.

Jacket 11 may be placed or inserted into revetment structure 9 after the grids 13 forming the structure are in place, or grids 13 may be threaded onto jacket 11 during the process of forming revetment structure 9. In either event, connecting means 19 may be placed in jacket 11 before or after jacket 11 is placed in revetment structure 9 or grids 13.

Figure 5:
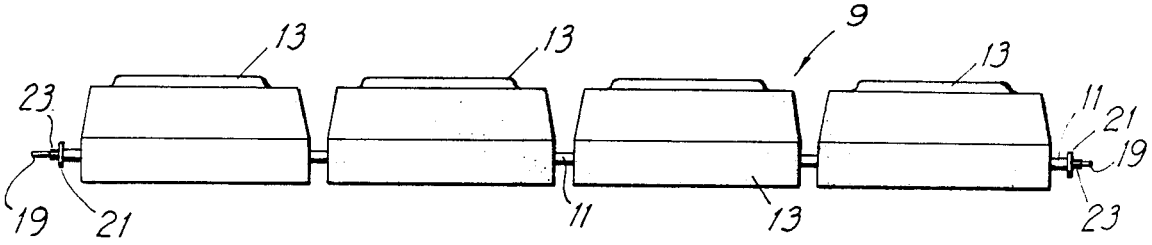
FIG. 5 is a schematic side elevational view of the revetment structure of FIG. 1 incorporating the protective jacket of the present invention.

FIG. 5 schematically illustrates the areas of connecting means 19 which are directly protected by jacket 11 of the present invention against degradation, deterioration and corrosion by sunlight and the elements. It also illustrates placement of washers 21 and swage fittings 2 on connecting means 19.

Washers 21 and swage fittings 23 may be placed on connecting means 19 adjacent to either end of jacket 11 to help seal the ends of jacket 11 and to prevent it and connecting means 19 from sliding out of revetment structure 9. In the depicted embodiment, as illustrated in FIGS. 1 through 3 and 5, such washers 21 placed at either end of jacket 11 are of diameter larger than opening 17 in grid 13, in order to retain jacket 11 within revetment structure 9, but in any case washers 21 should be of large enough diameter effectively to help seal the ends of jacket 11. Swage fittings 23 may also take the form of clamps or other devices which can be affixed to connecting means 19.

In some instances, connecting means 19 is threaded continually through revetment structure 9 so that it leaves one opening 17 of an end grid 13 and reenters another opening 17 on the periphery of revetment structure 9 without interruption or being cut or broken to once again extend through revetment structure 9 to the other end, where it once again leaves one opening 17 to reenter another without interruption. In such cases, jacket 11 may also extend continually throughout revetment structure 9 in this manner. Where necessary, abutting ends of jacket 11 may be joined together by heat-bonding or other means, as mentioned above. Such an installation of connecting means 19 and jacket 11 results in lesser exposure of connecting means 19 to the environment than installations in which jacket 11 extends through revetment structure 9 but stops beyond the edge 20 of each opening 17 of an end or peripheral grid 13.

The foregoing description of the present invention is for purposes of explanation and illustration. It will be apparent to those skilled in the relevant art that modifications and changes may be made to the invention as thus described without departing from its scope and spirit.

I claim:

1. A flexible revetment structure, comprising:

(A) A plurality of rectangular precast grids in substantially abutting relationship of staggered interlocking rows, each of said grids having:

(a) two opposed longer sides, each of said longer sides having:

(i) a lower vertical surface;

(ii) an upper sloping surface which slopes inward from the longer side lower vertical surface; and (iii) a vertical channel;

(b) two opposed shorter sides, each of said shorter sides having:

(i) a lower vertical surface;

(ii) an upper sloping surface which slopes inward from the shorter side lower vertical surface; and (iii) a vertical channel of depth approximately equivalent to the difference in length between the longer and shorter sides and width sufficient to receive projecting portions of the shorter sides of two like grids in staggered abutting relationship with said grid, said vertical channel having:

(x) two tiers;

(y) lower vertical first and second tier surfaces; and (z) upper sloping first and second tier surfaces;

(c) a horizontal lower top surface extending around the periphery of the grid;

(d) a horizontal upper top surface raised slightly above the lower top surface; and (e) a plurality of through tunnels extending horizontally parallel to the larger sides;

(B) a plurality of connecting means extending through the tunnels and interconnecting the grids; and (C) tubing to receive the connecting means, which tubing itself is disposed within the tunnels in the grids, and extends through the revetment structure.

2. A flexible revetment structure according to claim 1 wherein said tubing is:

(a) of sufficient length to extend beyond the outer edges of said tunnels of said grids on the periphery of the revetment structure, for any disposition, placement or arrangement of the revetment structure; and (b) of material resistant to penetration by and degradation and deterioration caused by sunlight and ultraviolet light, and impermeable to air and water.

3. A flexible revetment structure according to claim 2 further comprising at least one washer placed about, and at least one swage fitting attached to, said connecting means adjacent to at least one end of said tubing.

* * * * *